United States Patent [19]

Muckelrath

[11] 4,182,303

[45] Jan. 8, 1980

[54] STACKED INDIRECT AIR HEATER WITH SINGLE PATH AIRFLOW

[75] Inventor: Ernest R. Muckelrath, Tioga, N. Dak.

[73] Assignee: Tioga Air Heaters Co., Tioga, N. Dak.

[21] Appl. No.: 877,991

[22] Filed: Feb. 15, 1978

[51] Int. Cl.[2] ..... F24B 7/00

[52] U.S. Cl. ..... 126/72; 126/110 R

[58] Field of Search ..... 126/72, 73, 110 R, 109 R, 126/104 R

[56] References Cited

U.S. PATENT DOCUMENTS

| | | | |
|---|---|---|---|
| 1,619,567 | 3/1927 | Croan | 126/104 R |
| 1,951,855 | 3/1934 | Zylstra | 126/72 |
| 2,104,181 | 1/1938 | Bertossa | 126/110 R |
| 2,603,207 | 7/1952 | Muhlenkort | 126/110 |
| 3,106,200 | 10/1963 | Muckelrath | 126/109 |
| 3,388,697 | 6/1968 | Muckelrath | 126/110 R |

*Primary Examiner*—Samuel Scott
*Assistant Examiner*—Wesley S. Ratliff, Jr.
*Attorney, Agent, or Firm*—Clarence A. O'Brien; Harvey B. Jacobson

[57] ABSTRACT

An indirect air heater having a single airflow path, the invention provides apparatus capable of discharging large volumes of heated air either toward outdoor work areas or into indoor spaces. The present heater is disposed outdoors, fresh air being taken into the heater and passed in heat exchanging contact with heated combustion products moving in a non-communicating flow within the heater. The heated fresh air is directed toward or into the space to be heated while the combustion products are vented to ambient.

4 Claims, 3 Drawing Figures

STACKED INDIRECT AIR HEATER WITH SINGLE PATH AIRFLOW

BACKGROUND OF THE INVENTION

1. Field of the Invention

The present invention relates generally to apparatus for heating enclosures from the exterior of the enclosure, the apparatus being also suitable for heating outdoor areas by discharging large volumes of heated air toward such areas.

2. Description of the Prior Art

Large capacity heaters are known in the art to be capable of heating fresh air drawn into the heater and passed in non-communicating heat exchanging relation to a flow of heated gaseous combustion products produced by the combustion of an oxidizable material within the heater. Muckelrath, in U.S. Pat. Nos. 3,388,697 and 3,106,200, discloses such heaters, the heaters being typically used to warm relatively large indoor areas from externally thereof, the indoor areas not readily being provided with flues or other venting arrangements which would allow the use of indoor heating apparatus. The heaters discloses in the aforesaid patents also find use in the warming of exterior work areas, such as drilling sites, construction sites, and the like, the relatively warmer work conditions rendered possible by the heaters enabling both men and machinery to perform work under adverse thermal conditions. The heater of U.S. Pat. No. 3,388,697, is comprised of upper and lower tubular members within which non-communicating combustion gas and fresh air passages are defined, the fresh air being pre-heated on intake thereof into the upper tubular member and further heated on passage over exterior surfaces of a fire tube within which an oxidizable material, such as gas or oil, is combusted. The combustion products flow from the lower tubular member to provide heat energy to the pre-heating zone within the upper tubular member prior to venting to ambient from said upper tubular member. Heaters formed of upper and lower tubular members as disclosed in U.S. Pat. No. 3,388,697 do not provide the improved thermal capabilities of the present invention due to a comparatively greater heat loss from such heaters occasioned by the greater exterior surface area presented to ambient by such heaters. The heater of U.S. Pat. No. 3,106,200 provides a similar heater having multiple flow paths, the fresh air and combustion gas flow paths being contained within a single housing. The heater disclosed in this patent does not provide a single fresh air flow path which allows intimate heat exchanging contact between the pre-heated fresh air and the exterior wall surfaces of a fire tube within which an oxidizable material is subjected to combustion. Prior heaters do not provide the thermal advantages provided by the present heating apparatus, the pre-heated fresh air within the present apparatus being brought into full heat exchanging contact with a heated fire tube disposed within lower portions of the housing of the heater. In particular, the present heater provides a fresh air flow circulation which completely surrounds the fire tube and flows along the fire tube for substantially the full length thereof, thereby maximizing heat exchange between the fire tube and the pre-heated fresh air prior to discharge of the heated fresh air into the area to be heated.

SUMMARY OF THE INVENTION

The invention provides heating apparatus capable of heating the interior of an enclosure, the present heating apparatus being particularly useful when the enclosure is either not provided with an entrance of sufficient size to allow placement of a relatively large high capacity heater therein or not provided with adequate ventilation capability. Since heaters using combustible fuel must be vented to ambient, it is often desirable to position such a heater, particularly a high capacity heater, externally of the enclosure in order to directly dissipate the exhaust into the ambient atmosphere. Under such use circumstances, the heating apparatus must include an external housing capable of resisting the corrosive effects of the environment, the housing also being intended to provide a pleasant appearance.

According to the basic concepts of the present invention, a heating apparatus comprises a single housing having both a fresh air flow path and a combustion gas flow path defined therewithin, fresh air being taken into the apparatus through a plurality of air intake tubes about which heated combustion gases pass in heat exchanging relation to preheat the incoming fresh air prior to exhaust of said combustion gases from the apparatus. The air intake tubes discharge the preheated fresh air into a common air chamber, the common air chamber having a fire tube disposed therein. An oxidizable material is subjected to combustion substantially within the fire tube, the fire tube becoming heated to a high temperature and exchanging heat with the preheated fresh air circulating over the external surfaces of said fire tube in heat exchanging relation therewith. The fully heated fresh air is then discharged from the apparatus into an enclosure or other area which is to be heated. The combustion gases moving out of the fire tube are caused to circulte in heat exchanging relation with the air intake tubes prior to venting of the combustion gases from the apparatus, the incoming fresh air thereby being preheated as aforesaid. A blower is disposed at the fresh air discharge end of the heating apparatus to facilitate discharge of the heated air and for maintaining a flow of fresh air through the apparatus. The path taken by the fresh air through the heating apparatus is completely separate from the flow path of the combustion gases, the relatively hot combustion gases flowing in non-communicating and heat exchanging relation to the relatively cooler fresh air which is being heated within the apparatus and discharged therefrom for use. Accordingly, the separate fresh air and combustion gas flow paths, although substantially coextensive, do not commingle, the fresh air heated within the present heating apparatus therefore not being adulterated with noxious combustion products.

The present heating apparatus further provides a more energy efficient device than do the devices of the prior art. In particular, the present apparatus provides a single housing within which the complete flow paths of both the fresh air and combustion gas circulations are defined, heat energy lost by the several heat loss mechanisms being thereby minimized. In addition, the fresh air flow path within the present heating apparatus includes a segment thereof which brings the fresh air into heat exchanging contact with substantially the full exterior surfaces of a fire tube through which the combustion gases are passed after combustion at one end thereof. The fresh air heated within the present heating apparatus is thereby more efficiently heated, less heat energy being discharged from the apparatus with the combustion gases, and thereby wasted, less fuel thereby being required for a given heat value in the fresh air flow discharged from the heating apparatus.

Accordingly, it is an object of the present invention to provide an area heater which is capable of discharging a large volume of relatively constant temperature heated air.

It is a further object of the invention to provide an air discharging heater wherein the discharged air is free of combustion products, thereby eliminating potential dangers which would arise on heating of an enclosed area.

It is another object of the invention to provide a heating apparatus wherein fresh air taken into the apparatus is initially preheated and finally heated immediately before discharge from the apparatus, final heating of the fresh air being accomplished by direct heat exchanging contact between the flow of fresh air and a fire tube through which gaseous combustion products are moved.

It is a further object of the invention to provide a heating apparatus which is compact, efficient, and durable, the apparatus being capable of operation under extreme environmental conditions.

It is a still further object of the invention to provide a heating apparatus having fresh air intake and discharge locations, a blower communicating with the discharge portion of the apparatus being adapted to draw fresh air through the apparatus in order to eliminate static air pressure problems.

These together with other objects and advantages which will become subsequently apparent reside in the details of construction and operation as more fully herein described and claimed, reference being had to the accompanying drawings forming a part thereof, wherein like numerals refer to like parts throughout.

DESCRIPTION OF THE PREFERRED EMBODIMENTS

Figure 3:
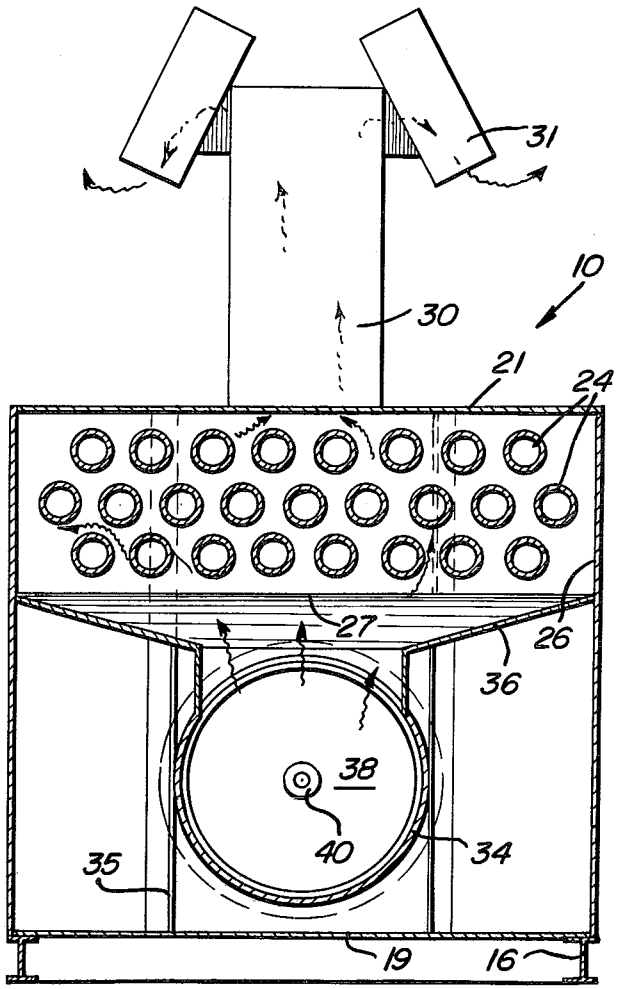
FIG. 3 is a sectional view taken substantially along line 3—3 of FIG. 2.
Figure 1:
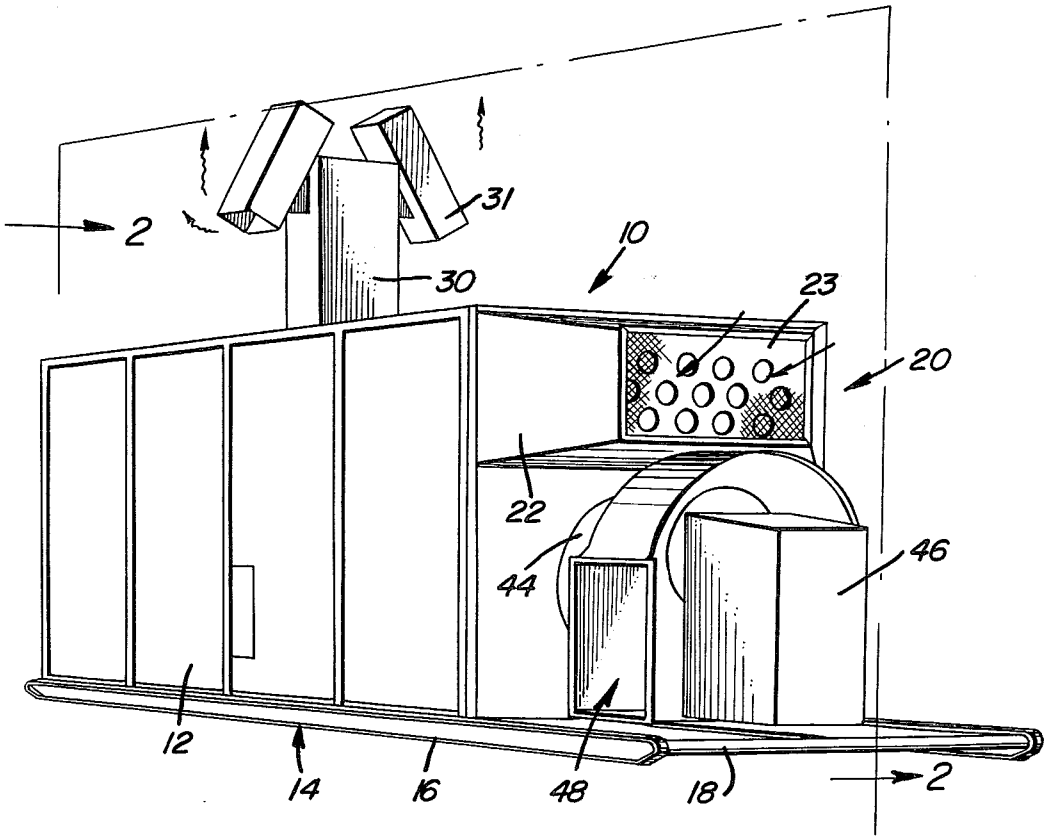
FIG. 1 is a perspective view of the present heating apparatus.
Figure 2:
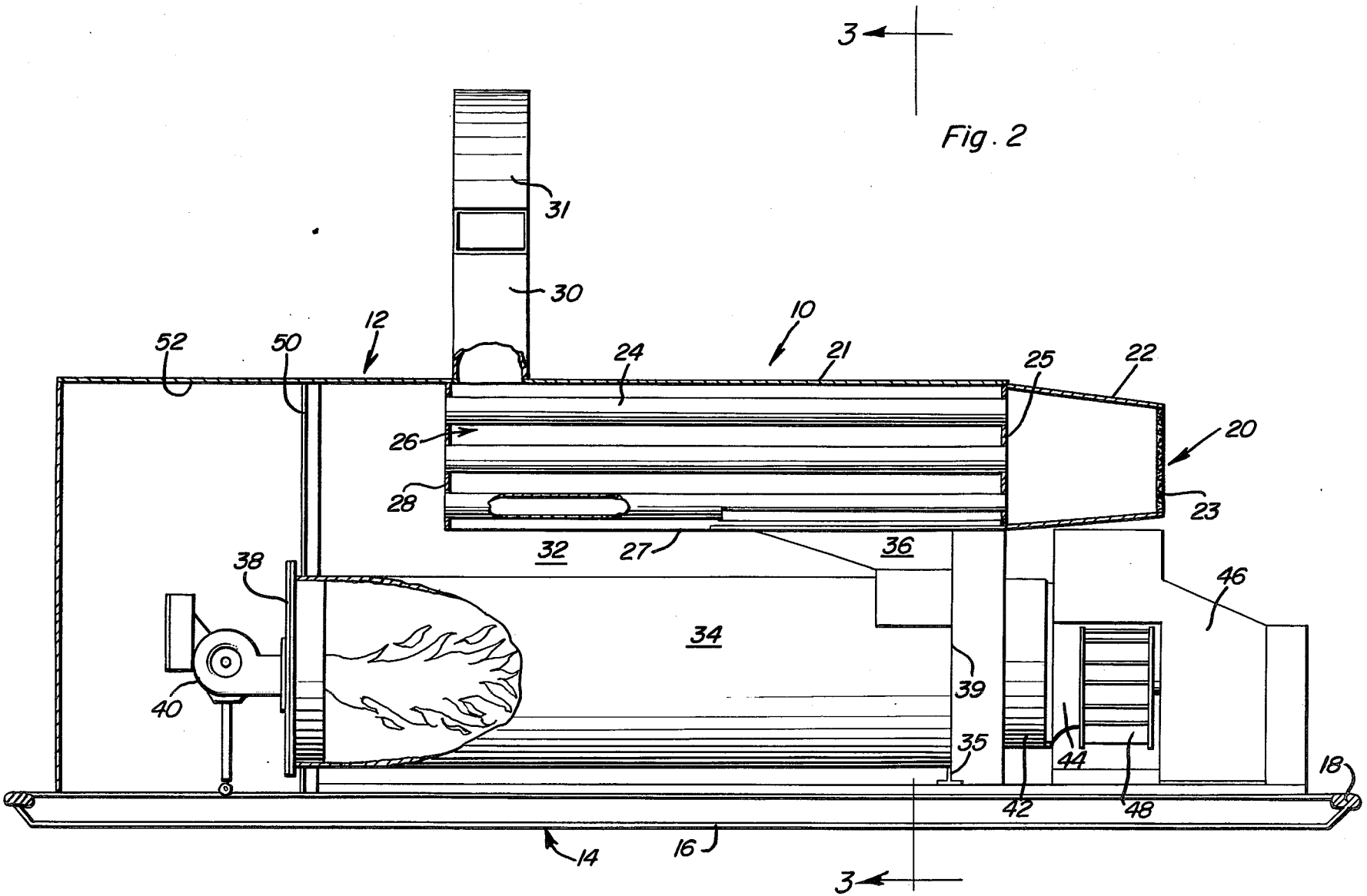
FIG. 2 is a sectional view taken substantially along line 2—2 of FIG. 1.

Referring now to the drawings, the heating apparatus of the invention is seen generally at 10 to comprise a housing 12 which is mounted for sliding transport on a skid support 14. The skid support 14 is comprised of at least two longitudinally extending side rails 16, the side rails 16 being laterally interconnected by cross rails 18. The housing 12 is preferably shaped in the form of a rectangular solid, a floor 19 mounting the side and end walls in a known fashion. The floor 19 is itself mounted directly to upper edge portions of the side rails 16 and cross rails 18. A top wall 21 is oppositely spaced from the floor 19 and is mounted to the upper perimeter of the housing 12 defined by upper edge portions of the side and end walls thereof. The housing 12 can be insulated in a known fashion in order to minimize heat loss therefrom by any of the several heat loss mechanisms which act to cause heat loss from the heating apparatus 10.

Fresh air is taken into the heating apparatus 10 through a fresh air intake located generally at 20, the fresh air intake 20 being surmounted by an intake canopy 22 which can be provided with a baffle screen 23 in order to prevent the intake of foreign objects into the fresh air intake 20. A plurality of air intake tubes 24 have their outer ends mounted by an air intake plate 25, the outer ends of said air intake tubes 24 being mounted within correspondingly sized apertures in said air intake plate 25. The air intake tubes 24 extend longitudinally of the heating apparatus 10 and are mounted at the inner ends thereof in a back plate 28, the inner ends of said tubes 24 being similarly mounted within apertures in the back plate 28. The air intake tubes 24 lie within a pre-heating chamber 26 which is defined by the air intake plate 25 and the back plate 28 at opposite ends thereof and by a portion of the top wall 21 and an oppositely spaced partition or bottom wall 27 at upper and lower portions of said pre-heating chamber 26. The pre-heating chamber is further defined along side portions thereof by portions of the side walls of the housing 12. Accordingly, a pre-heating chamber 26 is defined, the chamber 26 having the air intake tubes 24 disposed therewithin in spaced relation to each other. Heated gaseous products of combustion which are caused to move into and through the pre-heating chamber 26 as will be described hereinafter come into heat exchanging contact with exterior surfaces of the air intake tubes 24, thereby pre-heating the fresh air being drawn into the tubes 24 through the fresh air intake 20.

On passage of the now pre-heated fresh air through the air intake tubes 24 and out of the inner ends thereof, the pre-heated fresh air moves into a heating chamber 32 which comprises major lower portions of the interior of the housing 12 and that portion of the interior of the housing 12 immediately rearwardly of the back plate 28. The pre-heated fresh air moves downwardly within the heating chamber 32 and into contact with exterior surfaces of a fire tube 34, the fire tube 34 being heated to a relatively high temperature by means of heated gaseous products of combustion which are caused to flow longitudinally through said fire tube 34 from a burner 40 disposed at one end of the fire tube. Thus, heat is exchanged from the fire tube 34 to the pre-heated fresh air flowing along and around said fire tube 34 in heat exchanging contact therewith, the pre-heated fresh air being thereby heated to a higher temerature prior to discarge thereof from the heating apparatus 10 as will be described hereinafter. The fire tube 34 is mounted within the heating chamber 32 on support stanchions 35, the support stanchions 35 holding the fire tube in spaced relation to the floor 19 in order to allow flow of fresh air completely around said fire tube 34. The burner 40 is preferably disposed externally of the fire tube 34, the burner 40 communicating with the interior of the fire tube 34 through an end plate 38 which seals off said fire tube 34 at one end thereof. The burner 40 is preferably disposed within a burner room 52 which lies within the housing 12 but separated from the heating chamber 32 by means of a rear wall 50, the rear wall 50 being insulated in order to prevent heat loss from the heating chamber 32 to the burner room 52. Air and a suitable fuel is mixed and oxidized by the burner 40, the flame thereby resulting being directed into the fire tube 34, the heated gaseous products of combustion heating the fire tube to a relatively hot condition. It is to be noted that the burner 40 can consist of one or more burner heads capable of burning any appropriate fuel, such as natural gas, liquid petroleum gas, diesel fuel oil, and the like.

The opposite end of the fire tube 34 is sealed off by means of an end plate 39, the heated gaseous products of combustion being vented from the fire tube 34 through a vertical duct 36 which communicates with the preheating chamber 26. Therefore, the hot gaseous products of combustion move through the fire tube 34 and give up a certain amount of heat to fresh air flowing in heat exchanging relation with the external surfaces of said fire tube 34. The heated gaseous products of combustion are then vented into the pre-heating chamber 26 and are caused to flow in heat exchanging relation with external surfaces of the air intake tubes 24. Additional heat is thereby exchanged from the heated gaseous products of combustion with fresh air flowing through the air intake tubes 24, the fresh air flowing within the tubes 24 thereby being preheated within the pre-heating chamber 26. The heated gaseous products of combustion, which combustion products have now had a substantial amount of heat removed therefrom, are vented from the housing 12 through a flue stack 30, the flue stack 30 communicating with the interior of the preheating chamber 26 through top wall 21. The flue stack 30 can be configured according to prior art practices, downwardly disposed side vents 31 being usefully employed in order to facilitate discharge of the gaseous products of combustion even during environmental conditions involving high velocity winds.

The fresh air which has been heated to a desired discharge temperature on heat exchanging contact with the tire tube 34 is discharged from the housing 12 through a discharge duct 42, the heated fresh air being taken into an intake end 44 of a blower 46 and discharged from said blower 46 through a discharge end 48 thereof. The discharge end 48 of the blower 46 directly communicates with the interior of an enclosure (not shown) or is directed in a suitable direction toward an area which is to be heated. The blower 46 operates to draw fresh air through the fresh air intake 20 and to circulate the fresh air through the interior of the housing 12 in the fresh air flow path so described, the blower 46 acting to draw fresh air through the heating apparatus 10 rather than blowing air through the apparatus. Static air pressure build up within the housing 12 is thereby eliminated.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An air heater including a hollow rectangular housing having top and bottom walls interconnected by upstanding opposite side and front and rear end walls, said end walls including upper and lower portions, a generally horizontal elongated partition extending between said side walls from said front end wall rearward to and terminating a spaced distance forward of said rear end wall, an upstanding partial wall connected and extending vertically between the rear end of said partition and said top wall and horizontally between the portions of said side walls disposed above rear end of said partition, said partition dividing the interior of said housing forward of said partial wall into upper and lower chambers, said partition and top wall defining an elongated closed preheating chamber therebetween extending between said one end and said partial back wall, said preheating chamber comprising said upper chamber, a plurality of horizontally and vertically spaced fresh air intake tubes extending lengthwise through said preheating chamber and opening, at their opposite front and rear ends, through said front end wall and said partial back wall, said intake tube being spaced from said top wall, said partition and said opposite side walls, an elongated fire tube disposed lengthwise in said lower chamber spaced below said partition and above said bottom wall, the rear end of said fire tube adjacent said rear wall being closed, supported from said rear wall and having fuel burner means associated therewith for burning fuel in said fire tube rear end, the front end of said fire tube being closed and terminating forwardly at a point spaced rearwardly of said front wall, an upstanding duct supported within said housing, said duct being spaced inwardly of said side walls and rearwardy of said front wall, the lower end of said duct opening downwardly into the forward end of said fire tube, the upper end of said duct opening upwardly through the forward end of said partition, said housing including a flue outlet opening into said preheating chamber adjacent and forward of said partial back wall, blower means stationarily supported forward of said front wall and including an air inlet opening into the interior of said housing through said front wall below said partition, said fresh air intake tubes and the interior of said housing exteriorly of said preheating chamber fire tube and said duct comprising portion of fresh air passage means defined in said housing for fresh air to be heated to pass through and be preheated and thereafter further heated in said housing, the fresh air passing through said fresh air passage means entering through the ends of said intake tubes, opening through said front end wall and egressing from said housing through said blower means inlet.

2. The air heater assembly of claim 1 wherein the fuel burner means is disposed exteriorly of the fire tube and communicates with the interior of the fire tube through said rear end wall.

3. The air heater assembly of claim 1 wherein the front end wall includes a forwardly and outwardly projecting tubular air intake canopy open at its forward end to ambient and into whose rear end the forward ends of the air intake tubes open.

4. The air heater assembly of claim 3 wherein the air intake means further includes a screen disposed over the open forward end thereof.

* * * * *